US011745928B2

(12) United States Patent
Chapjian

(10) Patent No.: US 11,745,928 B2
(45) Date of Patent: Sep. 5, 2023

(54) FAST FOOD BAG WITH TEAR AWAY PORTIONS

(71) Applicant: Hank Chapjian, Duarte, CA (US)

(72) Inventor: Hank Chapjian, Duarte, CA (US)

( * ) Notice: Subject to any disclaimer, the term of this patent is extended or adjusted under 35 U.S.C. 154(b) by 0 days.

(21) Appl. No.: 17/550,298

(22) Filed: Dec. 14, 2021

(65) Prior Publication Data

US 2022/0204234 A1 Jun. 30, 2022

Related U.S. Application Data

(60) Provisional application No. 63/132,398, filed on Dec. 30, 2020.

(51) Int. Cl.
*B65D 75/58* (2006.01)
*B65D 30/20* (2006.01)
*B65D 81/36* (2006.01)

(52) U.S. Cl.
CPC ..... *B65D 75/58* (2013.01); *B65D 31/10* (2013.01); *B65D 81/36* (2013.01)

(58) Field of Classification Search
CPC ..... B65D 81/36; B65D 31/10; B65D 75/58
USPC ..... 383/4
See application file for complete search history.

(56) References Cited

U.S. PATENT DOCUMENTS 2,831,624 A * 4/1958 Lever ..... B65D 5/4287 383/122
4,484,350 A * 11/1984 Gordon ..... B65D 31/10 493/308
4,618,992 A * 10/1986 La Grotteria ..... B65D 33/00 229/87.08
4,932,556 A * 6/1990 Hui ..... B65D 25/16 383/122
4,941,756 A * 7/1990 Price ..... B65D 33/00 206/542
5,279,456 A * 1/1994 Bernstein ..... B65D 75/14 229/80.5
5,328,265 A * 7/1994 Clooney ..... B65D 81/36 383/122
5,335,996 A * 8/1994 Cortopassi ..... B65D 31/02 229/87.05
5,507,579 A * 4/1996 Sorenson ..... B65D 31/10 383/207
5,540,333 A * 7/1996 Gonzalez ..... B65D 31/12 206/541
5,964,534 A * 10/1999 Welles ..... B65D 75/5827 229/87.08
5,988,882 A * 11/1999 Fisher ..... B32B 27/32 229/87.05
6,113,266 A * 9/2000 Skidmore ..... B60N 2/2839 383/207
7,360,256 B1 * 4/2008 Jiles ..... A41B 13/10 2/48
8,061,896 B2 * 11/2011 Delgado ..... B65D 33/105 206/549

(Continued)

*Primary Examiner* — Peter N Helvey
(74) *Attorney, Agent, or Firm* — Averill, Green & Kim; Philip Y Kim; Kenneth L Green

(57) ABSTRACT

A tear away food bag includes tear seams, or other features, providing controlled tearing away of portions of the bags. The food bag is suitable for use as a lunch bag, a picnic bag, or a take out food bag. A bottom portion of the bag may be torn away from the food bag to provide a food holder and top portions maybe torn away from the food bag to provide place mats.

12 Claims, 2 Drawing Sheets

(56) References Cited

U.S. PATENT DOCUMENTS

| | | | | |
|---|---|---|---|---|
| 8,322,925 | B2 * | 12/2012 | Soletski | B65D 33/02 383/105 |
| 9,119,451 | B2 * | 9/2015 | Vestweber | B65D 5/2038 |
| 2004/0136614 | A1 * | 7/2004 | Seidler | B65D 81/36 383/110 |
| 2007/0258662 | A1 * | 11/2007 | Venditti | B65D 81/36 383/207 |
| 2016/0375650 | A1 * | 12/2016 | Goecke | A47K 10/02 383/4 |
| 2022/0258923 | A1 * | 8/2022 | Nieuwenhuis | B65D 31/10 |

* cited by examiner

FAST FOOD BAG WITH TEAR AWAY PORTIONS

CROSS-REFERENCE TO RELATED APPLICATIONS

The present application claims the priority of U.S. Provisional Patent Application Ser. No. 63/132,398 filed Dec. 30, 2020, which application is incorporated in its entirety herein by reference.

BACKGROUND OF THE INVENTION

The present invention relates to food bags and in particular a food bag with tear away portions providing additional uses.

Food bags are generally used to carrying meals from a preparation area to a consumption area. The bags are generally disposed of after the food is removed, and have no further use.

BRIEF SUMMARY OF THE INVENTION

The present invention addresses the above and other needs by providing a tear away food bag which includes tear seams, or other features, providing controlled tearing away of portions of the bags. The food bag is suitable for use as a lunch bag, a picnic bag, or a take out food bag. A top portion tears away along the tear seams to provide a food holder. The top portion may further include tear seams to provide place mats.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement, or typically within 10 percent of a stated value.

Figure 1:
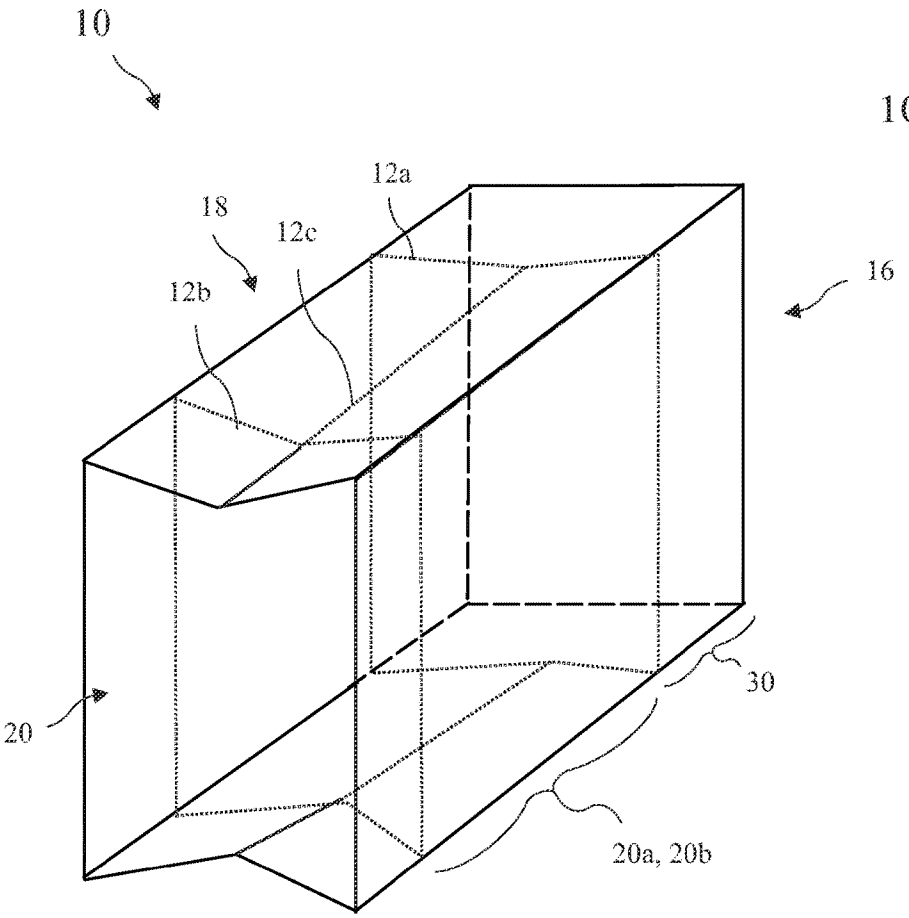
FIG. 1 shows a tear away food bag according to the present invention.

A tear away food bag 10 according to the present invention is shown in FIG. 1. The tear away food bag 10 may be a lunch or picnic bag purchased empty for use by consumer, or carry out bag provided by restaurants or take out fast food establishments. The tear away food bag 10 includes a bottom 16, four sides 18 and commonly, but not required, an open top 20. The tear away food bag 10 is preferably made from paper material.

The tear away food bag 10 tears along a bottom circumferential tear seam 12*a* and a top circumferential tear seam 12*b*, and vertical tear seams 12*c*, and folds along lines 14 (see FIG. 2) and includes tear away place mats 20*a* and 20*b*, and a tear away food holder 30. The tear seams 12*a*, 12*b*, and 12*c* are preferably perforations but those skilled in the art will recognize that other tear seams, and a tear away food bag with any form of tear seam is intended to come within the scope of the present invention. For example, a tear seam may be a very thin seam in the paper or a layer of thin tapes over a cut in the paper.

Figure 2:
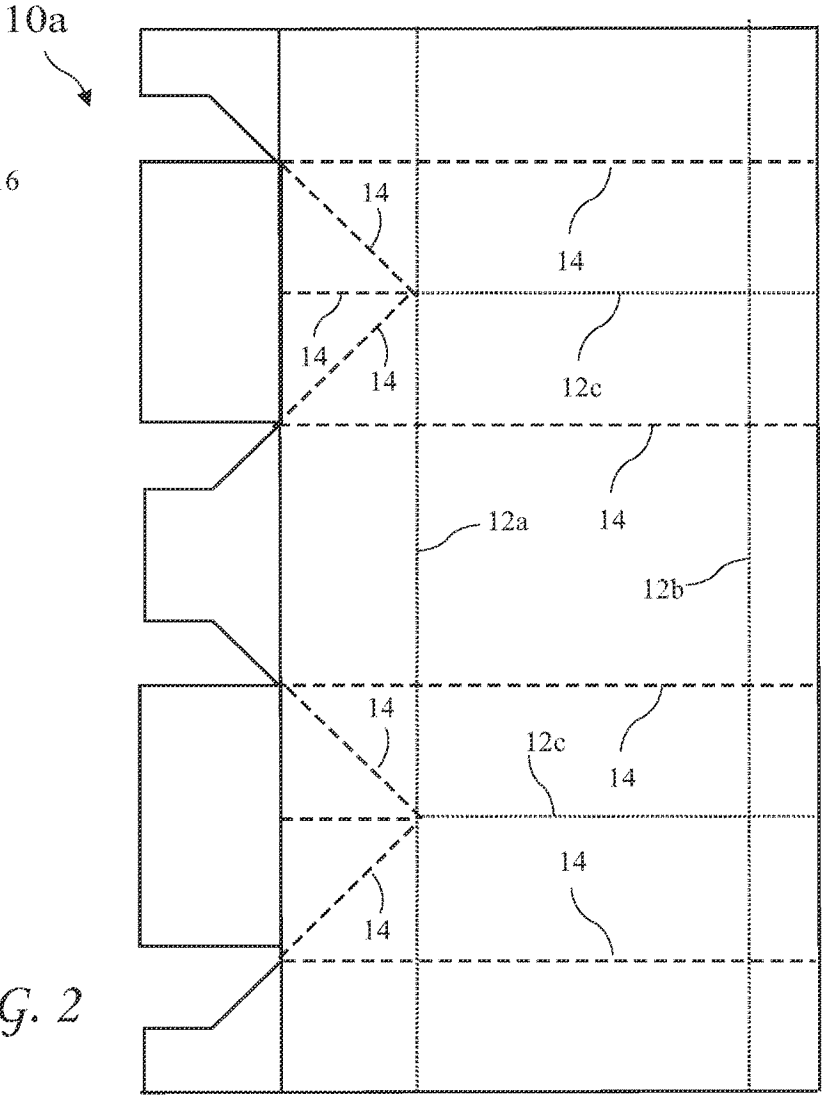
FIG. 2 shows an example of the tear away food bag according to the present invention before joining seems to form the useable food bag.

An example of a flat tear away food bag 10*a* before assembling the useable tear away food bag 10 is shown in FIG. 2. The tear seams 12*a*, 12*b*, and 12*c* are shown as dotted lines and the fold lines 14 are shown as dashed lines. Those skilled in the art will recognize that various flat forms may be assembled to construct a food bag, and a tear away food bag constructed from any flat form is intended to come within the scope of the present invention.

Figure 4A:
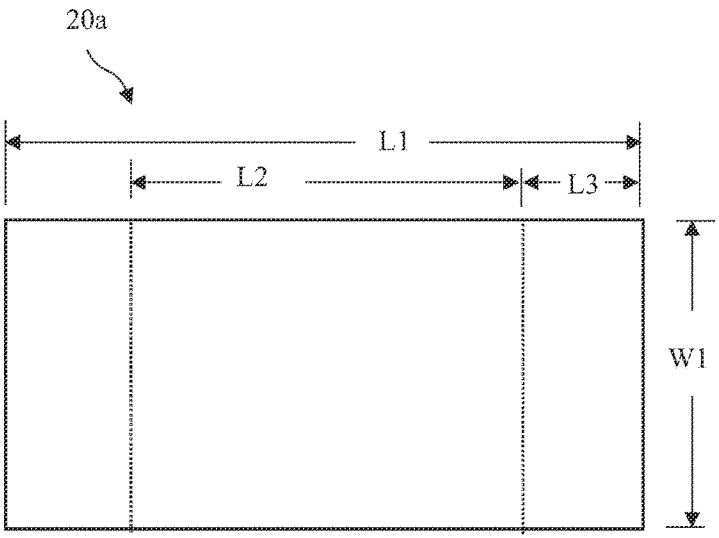
FIGS. 4A and 4B show place mats torn from the tear away food bag according to the present invention.
Figure 4B:
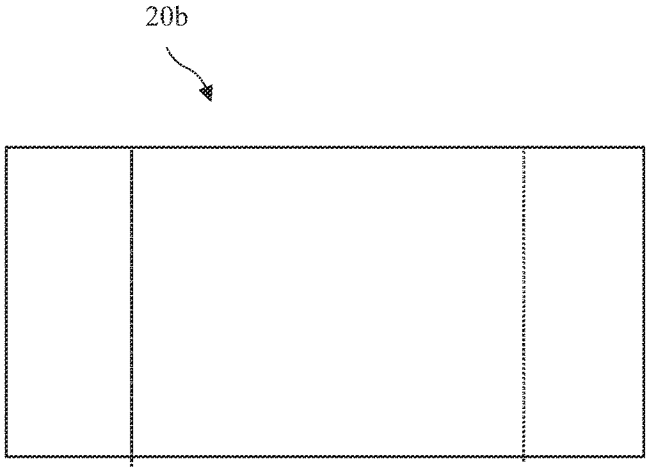
Figure 3:
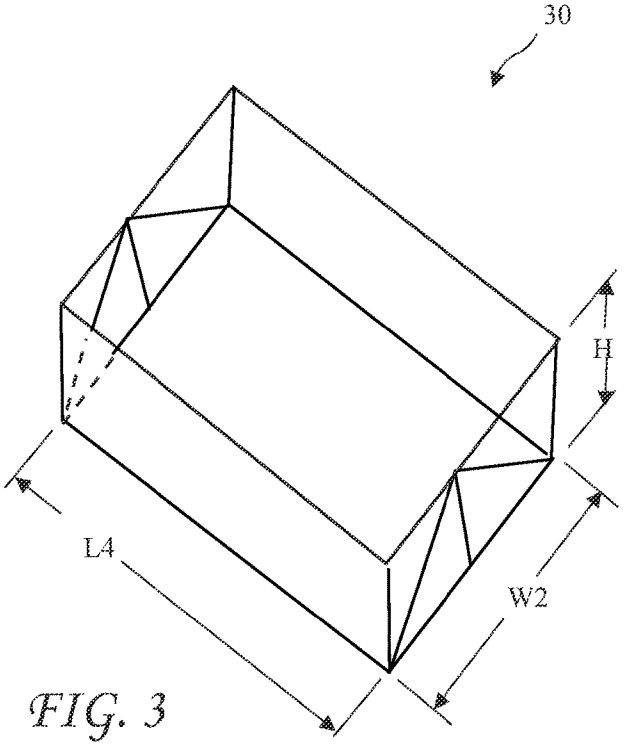
FIG. 3 shows a food holder torn from the tear away food bag according to the present invention.

A food holder 30 torn from the tear away food bag 10 is shown in FIG. 3 and place mats 20*a* and 20*b* torn from the tear away food bag 10 are shown in FIGS. 4A and 4B. The place mats 20*a* and 20*b* and food holder 30 provide further use of the tear away food bag 10. The food holder 30 has a height H which is generally fixed around the food bag 10 circumference.

The place mats 20*a* and 20*b* have an overall length L1, a center portion length L2, end portion lengths L3, and a width W1. The food holder 30 portion has a length L4, a width W2 and the height H. The length L1 is preferably between 8 and 13 inches. The length L2 is preferably between 3.25 and 8.5 inches. The width W1 is preferably between 8 and 9.5 inches. The length L4 is preferably between 3.25 and 8.5 inches. The width W2 between 3.25 and 4.75 inches. The height H is preferably between 1 and 6 inches, and more preferably between 1.5 and 2.5 inches, and is most preferably about 2 inches.

While the invention herein disclosed has been described by means of specific embodiments and applications thereof, numerous modifications and variations could be made thereto by those skilled in the art without departing from the scope of the invention set forth in the claims.

I claim:

1. A food bag comprising:

a paper material;

a bag bottom;

four sides reaching up from the bottom;

a bottom circumferential tear seam around the four side and above the bag bottom; and a bottom portion of the food bag separable from the food bag at the bottom circumferential tear seam to provide a food holder, and further including:

a top circumferential tear seam proximal to a bag top;

at least one vertical tear seam in one of the four sides, extending between the bottom circumferential tear seam and the top circumferential tear seam; and the food bag tearable along the vertical tear seam, the bottom circumferential tear seam, and the top circumferential tear seam to provide a place mat.

2. The food bag of claim 1, wherein the bottom circumferential tear seam is between 1 and 6 inches above the bag bottom.

3. The food bag of claim 2, wherein the bottom circumferential tear seam is a generally fixed height H above the bag bottom.

4. The food bag of claim 3, wherein the bottom circumferential tear seam is between 1.5 and 2.5 inches above the bag bottom.

5. The food bag of claim 4, wherein the bottom circumferential tear seam is about 2 inches above the bag bottom.

6. The food bag of claim 1, wherein the tear seam is formed by perforations in the paper material.

7. The food bag of claim 1, wherein the bag bottom is closed.

8. The food bag of claim 1, further including an open top.

9. The food bag of claim 1, wherein:

the at least one vertical tear seam is two vertical tear seams; and the food bag tearable along the vertical tear seams, the bottom circumferential tear seam, and the top circumferential tear seam to provide two of the place mats.

10. The food bag of claim 9, wherein the two vertical tear seams are on opposite side of the food bag.

11. A food bag comprising:

a paper material;

a closed bag bottom;

four sides reaching up from the bottom;

a bottom circumferential tear seam formed by first perforations in the paper material and around the four sides and above the bag bottom and a height between 1 and 6 inches above the bag bottom;

a bottom portion of the food bag separable from the food bag at the bottom circumferential tear seam to provide a food holder;

a top circumferential tear seam formed by second perforations proximal to a bag top;

two vertical tear seams formed by third perforations in the paper material, on opposite sides of the food bag, extending between the bottom circumferential tear seam and the top circumferential tear seam; and the food bag separable along the vertical tear seam, the bottom circumferential tear seam, and the top circumferential tear seam to provide two place mats.

12. A method for converting a food bag into a comprising:

providing the food bag made of a paper material, the food bag comprising:

a closed bag bottom;

four sides reaching up from the bottom; and a bottom circumferential tear seam formed by first perforations around the four side and between 1 and 6 inches above the bag bottom;

a top circumferential tear seam formed by second perforations proximal to a bag top; and two vertical tear seams formed by third perforations in the paper material, on opposite sides of the food bag, extending between the bottom circumferential tear seam and the top circumferential tear seam;

tearing the food bag along the bottom circumferential tear seam to form a food holder; and tearing the food bag along the vertical tear seam, the bottom and the top circumferential tear seam to provide two place mats.

* * * * *